US009366209B2

(12) United States Patent
Hashii et al.

(10) Patent No.: US 9,366,209 B2
(45) Date of Patent: Jun. 14, 2016

(54) FUEL INJECTION VALVE

(71) Applicant: Mitsubishi Electric Corporation, Chiyoda-ku, Tokyo (JP)

(72) Inventors: Naoya Hashii, Tokyo (JP); Tsuyoshi Munezane, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 203 days.

(21) Appl. No.: 14/140,865

(22) Filed: Dec. 26, 2013

(65) Prior Publication Data

US 2014/0103146 A1 Apr. 17, 2014

Related U.S. Application Data

(62) Division of application No. 13/279,431, filed on Oct. 24, 2011, now Pat. No. 8,967,500.

(30) Foreign Application Priority Data

Jun. 9, 2011 (JP) ..... 2011-129110

(51) Int. Cl.
*F02M 61/00* (2006.01)
*F02M 51/06* (2006.01)
*F02M 61/18* (2006.01)
(Continued)

(52) U.S. Cl.
CPC ..... *F02M 51/0671* (2013.01); *B21K 23/00* (2013.01); *F02M 51/0682* (2013.01); *F02M 61/168* (2013.01); *F02M 61/184* (2013.01);
(Continued)

(58) Field of Classification Search
CPC ..... F02M 61/184; F02M 61/146; F02M 61/1853; F02M 61/1846; F02M 61/188; F02M 61/1806; F02M 61/1833
USPC ..... 239/533.12, 596, 533.2, 533.9, 585.1, 239/601
See application file for complete search history.

(56) References Cited

U.S. PATENT DOCUMENTS 6,439,484 B2 * 8/2002 Harata ..... F02M 51/0614 239/552
6,848,636 B2 2/2005 Munezane et al.
(Continued)

FOREIGN PATENT DOCUMENTS

JP 2001317431 A 11/2001
JP 2004-137931 5/2004
(Continued)

OTHER PUBLICATIONS

Japanese Office Action issued Dec. 18, 2012, in Japanese Patent Application No. 2011-129110 and Machine Translation.

*Primary Examiner* — Len Tran
*Assistant Examiner* — Alexander Valvis
(74) *Attorney, Agent, or Firm* — Sughrue Mion, PLLC

(57) ABSTRACT

An injection hole inlet is disposed at the upstream side face of the injection hole plate in such a way that, assuming that α denotes the angle between respective lines obtained by vertically projecting a straight line that passes through the center of the injection hole inlet and the center of the valve seat and the major axis of the injection hole inlet onto a perpendicular plane that passes through the center of the injection hole inlet and is perpendicular to the center axis of the valve seat and assuming that β denotes the angle between respective lines obtained by vertically projecting the straight line that passes through the center of the injection hole inlet and the center of the valve seat and the minor axis of the injection hole inlet onto the perpendicular plane, α<β is satisfied.

4 Claims, 7 Drawing Sheets

(51) Int. Cl.
*F02M 61/16* (2006.01)
*B21K 23/00* (2006.01)

(52) U.S. Cl.
CPC ..... *F02M 61/1806* (2013.01); *F02M 61/186* (2013.01); *F02M 61/1813* (2013.01); *F02M 61/1826* (2013.01); *F02M 61/1833* (2013.01); *F02M 61/1846* (2013.01); *F02M 61/1853* (2013.01); *F02M 2200/8053* (2013.01); *F02M 2200/8069* (2013.01)

(56) References Cited

U.S. PATENT DOCUMENTS

| | | | | |
|---|---|---|---|---|
| 7,086,615 | B2 * | 8/2006 | Joseph | F02M 61/168 239/533.12 |
| 7,159,802 | B2 * | 1/2007 | Oomura | F02M 61/1853 239/533.12 |
| 8,016,214 | B2 * | 9/2011 | Higuma et al. | 239/533.12 |
| 8,631,579 | B2 * | 1/2014 | Miyagawa | B21D 53/84 29/890.142 |
| 2004/0074996 | A1 | 4/2004 | Munezane et al. | |
| 2010/0090031 | A1 * | 4/2010 | Hashii et al. | 239/533.12 |

FOREIGN PATENT DOCUMENTS

| | | | |
|---|---|---|---|
| JP | 2004137931 | A | 5/2004 |
| JP | 3644443 | B2 | 4/2005 |
| JP | 2006002720 | A | 1/2006 |
| JP | 3759918 | B2 | 3/2006 |
| JP | 2006-283703 | | 10/2006 |
| JP | 2006-336577 | | 12/2006 |
| JP | 2009-281347 | | 12/2009 |
| JP | 4510091 | B2 | 7/2010 |
| WO | 2008117459 | A1 | 10/2008 |

* cited by examiner

FUEL INJECTION VALVE

CROSS-REFERENCE TO RELATED APPLICATION

This application is a divisional of U.S. application Ser. No. 13/279,431 filed Oct. 24, 2011, which claims benefit of Japanese Patent Application No. JP-2011-129110. The above-noted application is incorporated herein by reference in its entirety.

BACKGROUND OF THE INVENTION

1. Field of the Invention

The present invention relates to a fuel injection valve that is utilized for supplying a fuel, for example, to the internal combustion engine of a vehicle.

2. Description of the Related Art

In recent years, while the regulation on exhaust gas of a vehicle or the like has been tightened, it has been required to atomize fuel spray injected from a fuel injection valve. In particular, with regard to the atomization of fuel spray, various kinds of studies have been made; for example, Patent Document 1 discloses a fuel injection valve whose injection hole inlet and injection hole outlet are made elliptical and slit-shaped, respectively, so that a uniform liquid film is formed and hence the atomization is facilitated.

Each of Patent Documents 2 and 3 discloses a fuel injection valve whose injection hole is made taper-shaped so that the atomization of fuel is facilitated.

Furthermore, Patent Document 4 discloses a fuel injection valve in which there are formed the respective concavees corresponding to the injection hole outlets of injection holes formed in an injection hole plate and each injection hole is formed in such a way as to step over the bottom plain of the concave so that the atomization is facilitated.

PRIOR ART REFERENCE

Patent Document

[Patent Document 1] Japanese Patent Application Laid-Open No. 2006-2720

[Patent Document 2] Japanese Patent Application Laid-Open No. 2001-317431

[Patent Document 3] Japanese Patent No. 3644443

[Patent Document 4] Japanese Patent No. 3759918

In the case of a conventional fuel injection valve disclosed in Patent Document 1, because the width of an injection hole narrows at the injection hole outlet, fuel flows in such a way as to fill the inside of the injection hole; therefore, in the case where when the fuel is injected under a high-temperature and negative-pressure condition, a gas-liquid two-phase flow is caused by low-pressure boiling at the upstream side of the injection hole, the pressure loss becomes large; thus, there has been a problem that the flow rate of the fuel to be injected fluctuates depending on the atmosphere.

In contrast, a conventional fuel injection valve disclosed in each of Patent Documents 2 through 4 has a structure in which because the injection hole outlet is wider than the injection hole inlet and hence the fuel does not fill the injection hole even under a high-temperature and negative-pressure condition, the effect of the pressure loss due to a gas-liquid two-phase flow is small and hence fluctuation in the injection amount depending on the atmosphere is small.

By taking a magnified picture of a fuel injected from an injection hole, in order to figure out the mechanism of fuel-injection atomization, it is known that in a fuel split process, because force that disperses the fuel overcomes the surface tension, the fuel splits from "a liquid film" into "liquid threads" and then from "a liquid thread" into "liquid droplets"; in addition, it is also known that once the fuel becomes "a liquid droplet", the effect of the surface tension becomes large and hence the split becomes unlikely to occur. Therefore, it is known that by injecting from an injection hole a fuel as a low-turbulence thin liquid film and making this liquid film split after widening it to be thinner, the atomization is facilitated, and when in contrast, turbulence occurs in the fuel flow, the fuel splits as a thick liquid film before the fuel liquid film is thinly widened and hence the liquid droplet after the split becomes large.

FIG. 8 is a set of explanatory views representing the detail of the front end portion of a conventional fuel injection valve; there is represented a case where as is the case with a fuel injection valve disclosed in each of Patent Documents 2 and 3, a taper-shaped injection hole is utilized. FIG. 8(*a*) is a cross-sectional view; FIG. 8(*b*) is a plan view when viewed in the direction of the arrow A in FIG. 8(*a*); FIG. 8(*c*) is an enlarged cross-sectional view taken along the line C-C; FIG. 8(*d*) is an enlarged view of the portion B. With regard to the fuel flow at a time when the valve is opened, as illustrated in FIG. 8, in a process where a fuel flow heading for the center axis of a valve seat 10 hits the inner wall of an injection hole 12 and a liquid film 17 is formed in the injection hole 12, a fuel flow 16*a* that enters the center of the injection hole 12 is converted into a fuel flow 16*c* that intends to widen the liquid film 17 along the inner wall of the injection hole 12 whose cross-sectional area becomes larger downstream; however, a fuel flow 16*b* that enters to the position, such as the periphery of the injection hole 12, that is apart from the center of the injection hole inlet is converted into a fuel flow 16*d* that opposes the fuel flow 16*c* that intends to widen the liquid film; thus, there has been a problem that because the both flows cancel out each other and become a thick liquid film 17*a*, the fuel film cannot efficiently be made thinner.

In addition, there has been a problem that because the fuel flow 16*c* that intends to widen the liquid film and the fuel flow 16*d* that opposes the fuel flow 16*c* collide with each other in the injection hole 12, turbulence is produced in the fuel flow and this turbulence deteriorates the droplet diameter.

SUMMARY OF THE INVENTION

The present invention has been implemented in order to solve the problems in the foregoing conventional apparatuses; the objective thereof is to provide a fuel injection valve that can efficiently make the film of a fuel thinner and can facilitate the atomization of the fuel.

In a fuel injection valve according to the present invention, there is provided a valve body that makes contact with or departs from a seat surface of a valve seat, and when the valve body departs from the seat surface of the valve seat, a fuel passes between the valve body and the seat surface of the valve seat and then is injected outward from a plurality of injection holes provided in an injection hole plate fixed to the valve seat; the fuel injection valve is characterized in that the seat surface of the valve seat is formed in such a way that the inner diameter thereof decreases in a direction from an upstream side to a downstream side of a flow of the fuel; the injection hole plate is disposed opposing a front end portion of the valve body in such a way that a virtual extension seat surface extended along the seat surface from a downstream edge of the seat surface and an upstream side face of the injection hole plate intersect each other to form a virtual circle; each of the plurality of injection holes provided in the injection hole plate has an injection hole inlet that opens in an oval shape at the upstream side face of the injection hole plate and an injection hole outlet that opens in an oval shape at a downstream side face of the injection hole plate, and an injection hole path between the injection hole inlet and the injection hole outlet is formed in such a way as to be slanted by a predetermined angle with respect to a depth direction of the injection hole plate; the injection hole inlet is disposed to be closer to the center axis of the valve seat than either the periphery of a valve seat opening portion having the minimum inner diameter of the valve seat or the injection hole outlet; the oblateness of the oval shape of the injection hole inlet, which is expressed by a value obtained by dividing the length of the major axis of the oval shape of the injection hole inlet by the length of the minor axis thereof, is made larger than the oblateness of the oval shape of the injection hole outlet, to the extent that the periphery of the injection hole inlet does not fall outside a virtual oval shape that is formed when the shape of the injection hole outlet is projected onto the upstream side face of the injection hole plate along the direction of the slant of the injection hole path; and the injection hole inlet is disposed at the upstream side face of the injection hole plate in such a way that, assuming that $\alpha$ denotes the angle between respective lines obtained by vertically projecting a straight line that passes through the center of the injection hole inlet and the center of the valve seat and the major axis of the injection hole inlet onto a perpendicular plane that passes through the center of the injection hole inlet and is perpendicular to the center axis of the valve seat and assuming that $\beta$ denotes the angle between respective lines obtained by vertically projecting the straight line that passes through the center of the injection hole inlet and the center of the valve seat and the minor axis of the injection hole inlet onto the perpendicular plane, $\alpha<\beta$ is satisfied.

Moreover, in a fuel injection valve according to the present invention, there is provided a valve body that makes contact with or departs from a seat surface of a valve seat, and when the valve body departs from the seat surface of the valve seat, a fuel passes between the valve body and the seat surface of the valve seat and then is injected outward from a plurality of injection holes provided in an injection hole plate fixed to the valve seat; the fuel injection valve is characterized in that the seat surface of the valve seat is formed in such a way that the inner diameter thereof decreases in a direction from an upstream side to a downstream side of a flow of the fuel; the injection hole plate is disposed opposing a front end portion of the valve body in such a way that a virtual extension seat surface extended along the seat surface from a downstream edge of the seat surface and an upstream side face of the injection hole plate intersect each other to form a virtual circle; each of the plurality of injection holes provided in the injection hole plate has an injection hole inlet that opens in an oval shape at the upstream side face of the injection hole plate and an injection hole outlet that opens in an oval shape at a downstream side face of the injection hole plate, and an injection hole path between the injection hole inlet and the injection hole outlet is formed in such a way as to be slanted by a predetermined angle with respect to a depth direction of the injection hole plate; the injection hole inlet is disposed to be closer to the center axis of the valve seat than either the periphery of a valve seat opening portion having the minimum inner diameter of the valve seat or the injection hole outlet; the shape of the injection hole inlet is formed in a sector shape and in such a way that the arc portion of the sector faces is disposed to be closer to the center axis of the valve seat, to the extent that the periphery of the injection hole inlet does not fall outside a virtual oval shape that is formed when the shape of the injection hole outlet is projected onto the upstream side face of the injection hole plate along the direction of the slant of the injection hole path; and assuming that $\theta$ denotes the angle between respective lines obtained by vertically projecting a straight line that passes through the center of the injection hole inlet and the center of the valve seat and the line that connects the middle point of the arc portion of the sector with the pivot point of the sector onto a perpendicular plane that passes through the center of the virtual oval shape and is perpendicular to the center axis of the valve seat, $\theta\leq45°$ is satisfied and hence the ratio of the portion, to the arc portion of the sector, that is disposed facing the center axis of the valve seat is made large.

In the fuel injection valve according to the present invention, the oblateness of the oval shape of an injection hole inlet is made larger than the oblateness of the oval shape of an injection hole outlet, to the extent that the periphery of the injection hole inlet does not fall outside a virtual oval shape that is formed when the shape of the injection hole outlet is projected onto the upstream side face of an injection hole plate along the direction of the slant of an injection hole path; and the injection hole inlet is disposed at the upstream side face of the injection hole plate in such a way that, assuming that $\alpha$ denotes the angle between respective lines obtained by vertically projecting a straight line that passes through the center of the injection hole inlet and the center of the valve seat and the major axis of the injection hole inlet onto a perpendicular plane that passes through the center of the injection hole inlet and is perpendicular to the center axis of the valve seat and assuming that $\beta$ denotes the angle between respective lines obtained by vertically projecting the straight line that passes through the center of the injection hole inlet and the center of the valve seat and the minor axis of the injection hole inlet onto the perpendicular plane, $\alpha<\beta$ is satisfied. As a result, the area of the injection hole inlet is made smaller than that of the injection hole outlet and the direction of fuel injection from the injection hole opposes a fuel flow from the valve seat to the injection hole; and because the major axis of the injection hole inlet is along the flow from the valve seat to the injection hole, the fuel enters the center of the injection hole and hence there is enhanced a flow that intends to widen the liquid film along the inner wall of the injection hole whose cross sectional area becomes larger downstream; therefore, there is demonstrated an effect that the fuel film can efficiently be thinned. Moreover, because a flow that opposes the flow that intends to widen the liquid film is suppressed, turbulence caused by collision of flows in the injection hole is also suppressed, whereby there is demonstrated an effect that the atomization is improved. Furthermore, because the injection hole outlet is wider than the injection hole inlet and hence the fuel does not fill the injection hole even under a high-temperature and negative-pressure condition, the effect of the pressure loss due to a gas-liquid two-phase flow is small, whereby there is demonstrated an effect that fluctuation in the injection amount depending on the atmosphere is small.

In the fuel injection valve according to the present invention, the shape of the injection hole inlet is formed in a sector shape, to the extent that the periphery of the injection hole inlet does not fall outside a virtual oval shape that is formed when the shape of the injection hole outlet is projected onto the upstream side face of the injection hole plate along the direction of the slant of the injection hole path, and is formed in such a way that the arc portion of the sector faces the center axis of the valve seat; and assuming that $\theta$ denotes the angle between respective lines obtained by vertically projecting a straight line that passes through the center of the injection hole inlet and the center of the valve seat and the line that connects the middle point of the arc portion of the sector with the pivot point of the sector onto a perpendicular plane that passes through the center of the virtual oval shape and is perpendicular to the center axis of the valve seat, $\theta \leq 45°$ is satisfied and hence the ratio of the portion, to the arc portion of the sector, that is disposed facing the center axis of the valve seat is made large. As a result, the area of the injection hole inlet is made smaller than that of the injection hole outlet and the direction of fuel injection from the injection hole opposes a fuel flow from the valve seat to the injection hole; and because the major axis of the injection hole inlet is along the flow from the valve seat to the injection hole, the fuel enters the center of the injection hole and hence there is enhanced a flow that intends to widen the liquid film along the inner wall of the injection hole whose cross sectional area becomes larger downstream; therefore, there is demonstrated an effect that the fuel film can efficiently be thinned. Moreover, because a flow that opposes the flow that intends to widen the liquid film is suppressed, turbulence caused by collision of flows in the injection hole is also suppressed, whereby there is demonstrated an effect that the atomization is improved. Furthermore, because the injection hole outlet is wider than the injection hole inlet and hence the fuel does not fill the injection hole even under a high-temperature and negative-pressure condition, the effect of the pressure loss due to a gas-liquid two-phase flow is small, whereby there is demonstrated an effect that fluctuation in the injection amount depending on the atmosphere is small.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
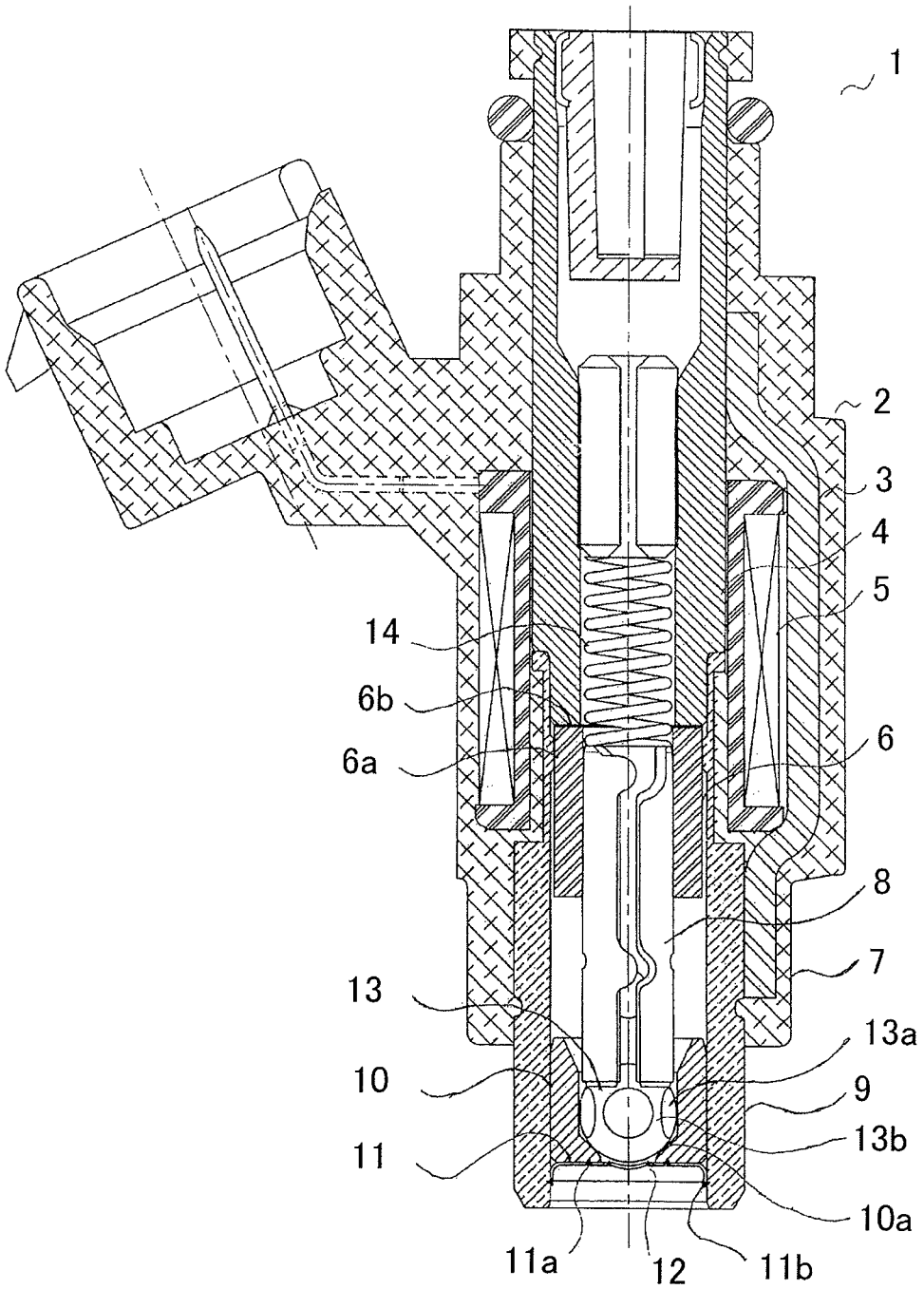
FIG. 1 is a cross-sectional view illustrating a fuel injection valve according to Embodiment 1 of the present invention.

FIG. 1 is a cross-sectional view illustrating a fuel injection valve according to Embodiment 1 of the present invention. In FIG. 1, a fuel injection valve 1 is provided with a solenoid device 2, a housing 3 which is a yoke portion of a magnetic circuit, a core 4 which is a fixed iron core portion of the magnetic circuit, a coil 5, an armature 6 which is a moving core portion of the magnetic circuit, and a valve device 7. The valve device 7 is configured with a cylindrical valve body 8 having a ball-shaped front end portion 13 at the front end thereof, a valve main body 9, and a valve seat 10.

The valve main body 9 is pressed onto the end portion outer circumferential surface of the core 4 and then is welded and fixed on the core 4. The armature 6 is pressed onto the valve body 8 and then is welded and fixed on the valve body 8. At the downstream side of the valve seat 10, an injection hole plate 11 is welded and combined with the valve seat 10 at a welding portion 11*a*. The valve seat 10, with the downstream side of which the injection hole plate 11 is combined, is inserted into the valve main body 9 and then is welded and combined with the valve main body 9 at a welding portion 11*b*. As described later, in the injection hole plate 11, there is provided a plurality of injection holes 12 that penetrate the injection hole plate 11 in the plate thickness direction thereof.

When an operation signal is transmitted from an engine control unit (unillustrated) to a drive circuit (unillustrated) for the fuel injection valve 1, the coil 5 of the fuel injection valve 1 is energized; magnetic flux is produced in the magnetic circuit configured with the armature 6, the core 4, the housing 3, and the valve main body 9; the armature 6 is attracted toward the core 4; then, the valve body 8 that is integrated with the armature 6 departs away from a seat surface 10*a* of the valve seat 10 and hence a gap is formed. Accordingly, the fuel is injected from a plurality of injection holes 12, described later, into an engine intake pipe after traveling from a plurality of grooves 13*a* provided in the front end portion 13 of the valve body 8 to the plurality of injection holes 12 through the gap between the seat surface 10*a* of the valve seat 10 and the valve body 8.

Next, when an operation stop signal is transmitted from the engine control unit to the drive circuit for the fuel injection valve 1, the energization of the coil 5 is stopped; the magnetic flux in the magnetic circuit decreases, and a compression spring 14, which biases the valve body 8 in such a way as to close the valve body 8, closes the gap between the valve body 8 and the seat surface 10*a* of the valve seat 10; then, fuel injection is ended. The valve body 8 slides on the inner circumferential surface of the valve main body 9 by the intermediary of a guide portion 6*a* of the armature 6; when the valve is opened, a top side 6*b* of the armature 6 makes contact with the bottom side of the core 4.

Figure 2:
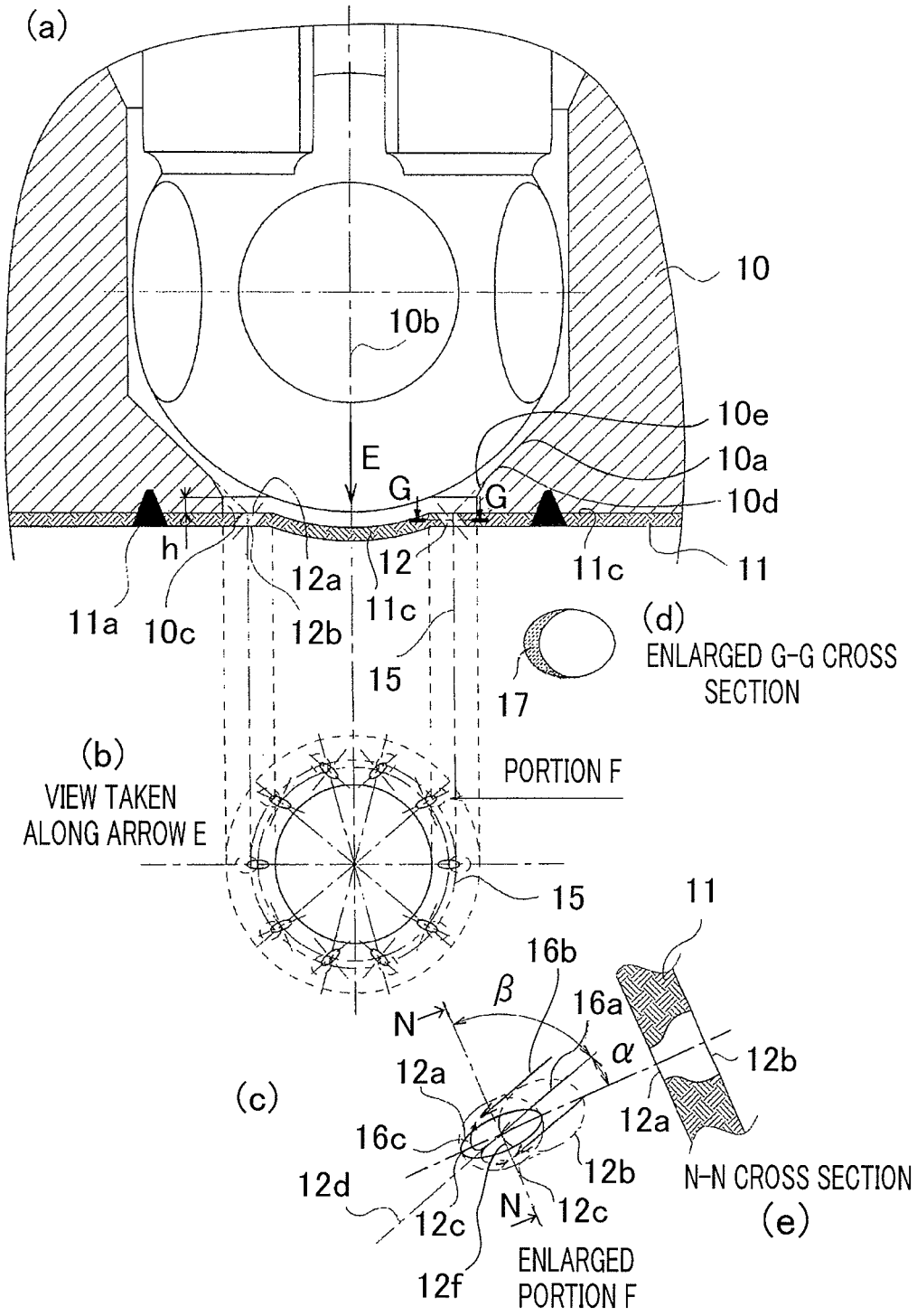
FIGS. 2*a*-2*e* are a set of explanatory views illustrating the detail of the front end portion of a fuel injection valve according to Embodiment 1 of the present invention.

FIG. 2 is a set of explanatory views illustrating the front end portion of a fuel injection valve according to Embodiment 1 of the present invention; FIG. 2(*a*) is a cross-sectional view; FIG. 2(*b*) is a plan view taken along the arrow E in FIG. 2(*a*); FIG. 2(*c*) is an enlarged view of the portion F; FIG. 2(*d*) is an enlarged cross-sectional view taken along the G-G line; and FIG. 2(*e*) is an enlarged view taken along the N-N line. In FIG. 2, the valve seat 10 is formed in such a way that the inner diameter thereof decreases in the downstream direction; the inner circumferential surface thereof is the seat surface 10*a*. The injection hole plate 11 is disposed in such a way that the extended line of the seat surface 10*a* of the valve seat 10 and an upstream side face 11*c* of the injection hole plate 11 intersect each other and a single virtual circle 15 is formed.

On a plane that is perpendicular to a center axis 10*b* of the valve seat 10, an injection hole inlet 12*a* of the injection hole 12 is disposed to be closer to the center axis 10*b* of the valve seat 10 than a valve seat opening portion 10*c* where the inner diameter of the valve seat 10 is minimum; an injection hole outlet 12*b*, at which the injection hole 12 opens in an oval shape at the downstream side face of the injection hole plate 11, is disposed to be radially farther from the center axis 10*b* of the valve seat 10 than the injection hole inlet 12*a* that opens in an oval shape on the upstream side face 11*c* of the injection hole plate 11. The injection hole 12 is formed to be slanted by a predetermined angle with respect to the plate depth direction of the injection hole plate 11 and is disposed in such a way that at least part of the injection hole inlet 12*a* is included in the virtual circle 15.

In order to suppress turbulence caused when the fuel departs from the seat surface 10*d* of the valve seat 10, there is provided, at the downstream side of a seat surface 10*d*, a taper surface 10*e* that is slanted at a small angle from the seat surface 10*d*. Furthermore, in order to suppress an inner-wall height h of the minimum inner diameter of the valve seat 10, at the center portion of the injection hole plate 11, there is provided, in the radially inner side of the virtual circle 15, a protrusion portion 11*c* that is approximately axisymmetric with respect to the center axis 10*b* of the valve seat 10 and whose cross section is arc-shaped and protrudes downstream in parallel with the valve-body front end portion 13. As a result, the front end portion 13 of the valve body 8 does not make contact with the upstream side face 11*c* of the injection hole plate 11.

It may be allowed that the injection hole plate 11 is made to be plane and a plane, parallel to the injection hole plate 11, is provided at the front end portion 13 of the valve body 8 so that the front end portion 13 of the valve body 8 and the upstream side face of the injection hole plate 11 do not make contact with each other.

The oblateness of the injection hole inlet 12*a* is made larger than that of the injection hole outlet 12*b* to the extent that the injection hole inlet 12*a* does not fall outside a virtual oval shape 12*c*, of the injection hole outlet, that is formed when the shape of the injection hole outlet 12*b* is projected onto the upstream side face 11*c* of the injection hole plate 11 along the slant direction of the injection hole 12. Here, the oblateness of the injection hole inlet 12*a* and the oblateness of the injection hole outlet 12*b* denote the value obtained by dividing the major axis of the injection hole inlet 12*a* by the minor axis thereof and the value obtained by dividing the major axis of the injection hole outlet 12*b* by the minor axis thereof, respectively. By making the oblateness of the injection hole inlet 12*a* to be larger than that of the injection hole outlet 12*b*, the area of the injection hole inlet 12*a* is made smaller than that of the injection hole outlet 12*b*.

The injection hole inlet 12*a* and the injection hole outlet 12*b* are formed in such a way that the respective major axes thereof are in the same direction. The minor axis of the injection hole inlet 12*a* is made to be shorter than that of the injection hole outlet 12*b*; however, the major axis of the injection hole inlet 12*a* is made to be the same as that of the injection hole outlet 12*b*.

Moreover, the injection hole inlet 12*a* is formed in such a way that, assuming that on a perpendicular plane that passes through the center of the injection hole inlet 12*a* and is perpendicular to the center axis 10*b* of the valve seat, $\alpha$ denotes the angle between a straight line 12*d* that passes through the center of the injection hole inlet 12*a* and the center axis 10*b* of the valve seat and a line 12*e* obtained by vertically projecting the major axis of the injection hole inlet 12*a* onto the perpendicular plane, and $\beta$ denotes the angle between the straight line 12*d* that passes through the center of the injection hole inlet 12*a* and the center axis 10*b* of the valve seat and a line 12*f* obtained by vertically projecting the minor axis of the injection hole inlet 12*a* onto the perpendicular plane, the relationship $\alpha<\beta$ is satisfied.

In Embodiment 1, the respective major axes of the injection hole inlet 12*a* and the injection hole outlet 12*b* are in the same direction; however, it is not necessarily required that the respective major axes of the injection hole inlet 12*a* and the injection hole outlet 12*b* are in the same direction, as long as the relationship $\alpha<\beta$ is satisfied and the shape of the injection hole inlet 12*a* falls within the virtual oval shape 12*c*.

Furthermore, in Embodiment 1, as far as the injection hole inlet 12*a* is concerned, only the minor axis thereof is made shorter than that of the injection hole outlet 12*b*; however, the major axis thereof may also be shorter than that of the injection hole outlet 12*b*.

In addition, in Embodiment 1, the cross sectional shape of the injection hole 12 is made elliptical; however it may be an oval or an ellipse.

In the foregoing fuel injection valve according to Embodiment 1 of the present invention, as illustrated in FIG. 2(*c*), the direction of fuel injection from the injection hole 12 opposes a fuel flow 16*a* from the valve seat surface to the injection hole 12, and the major axis of the injection hole inlet 12*a* is in the foregoing relationship $\alpha<\beta$; therefore, the ratio of the fuel flow 16*a*, to fuel flows that enter the injection hole inlet 12*a*, that enters the center of the injection hole inlet 12*a* becomes large. As a result, there is enhanced a flow 16*c* that intends to widen the liquid film 17 along the inner wall of the injection hole 12 whose cross section becomes larger downstream, whereby there is demonstrated an effect that fuel film can efficiently be thinned.

The ratio of a fuel flow 16*b*, to fuel flows that enter the injection hole inlet 12*a*, that enters the position apart from the center of the injection hole inlet 12*a* becomes small and hence the flow that opposes the flow that intends to widen the liquid film is suppressed; therefore, turbulence caused by collision of flows in the injection hole is also suppressed, whereby there is demonstrated an effect that the atomization is improved.

Because the cross section of the injection hole outlet 12*b* is made larger than that of the injection hole inlet 12*a*, the injection hole is not filled with fuel even under a high-temperature and negative-pressure condition and hence the effect of pressure loss caused by a gas-liquid two-phase flow is small; thus, the fuel injection valve according to Embodiment 1 of the present invention is characterized in that fluctuation in the injection amount due to the atmosphere is small.

Embodiment 2

Figure 3:
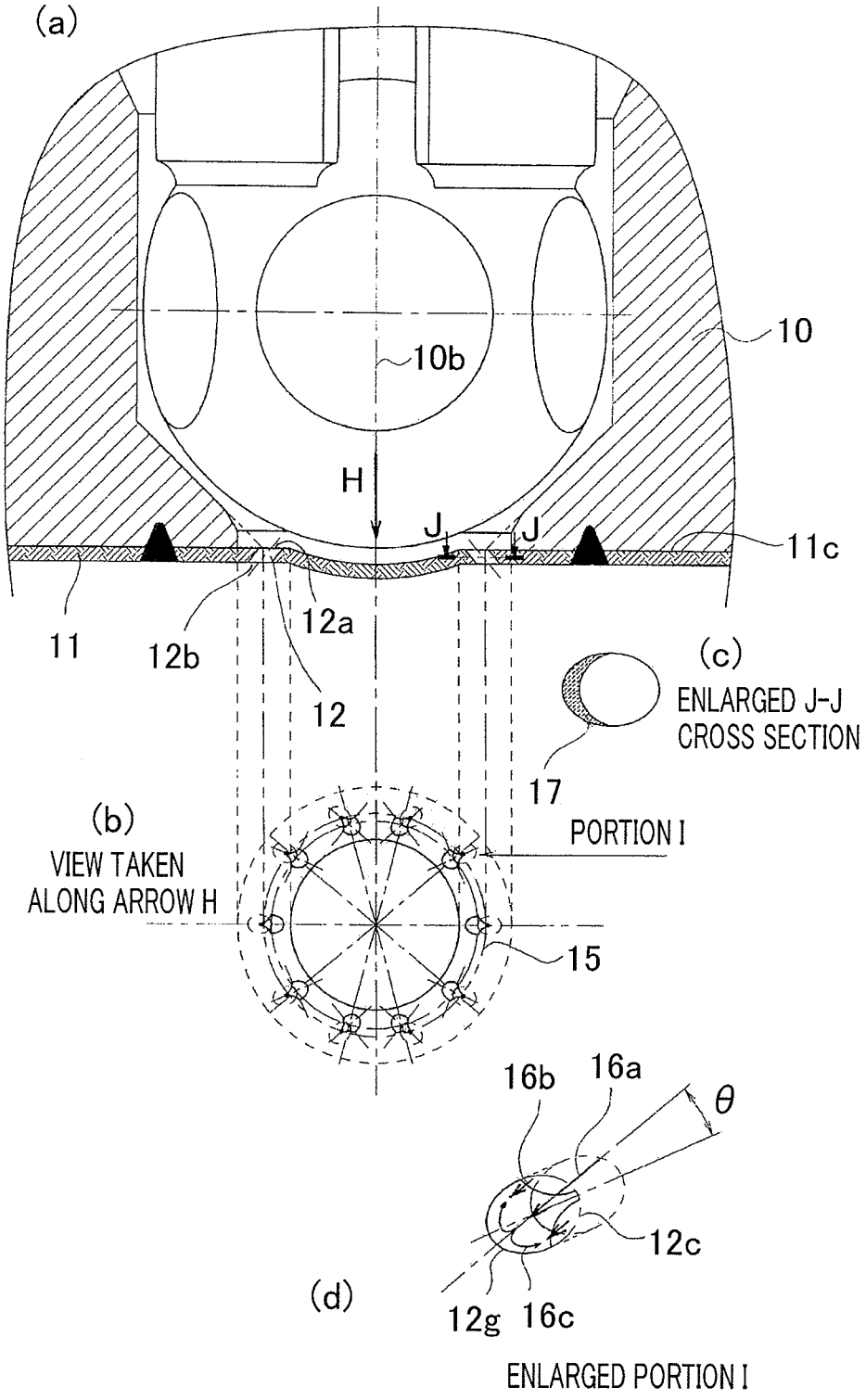
FIGS. 3*a*-3*d* are a set of explanatory views illustrating the detail of the front end portion of a fuel injection valve according to Embodiment 2 of the present invention.

FIG. 3 is a set of explanatory views illustrating the front end portion of a fuel injection valve according to Embodiment 2 of the present invention; FIG. 3(*a*) is a cross-sectional view; FIG. 3(*b*) is a plan view taken along the arrow H in FIG. 3(*a*); FIG. 3(*c*) is an enlarged cross-sectional view taken along the J-J line; and FIG. 3(*d*) is an enlarged view of the portion I. In FIG. 3, the cross-sectional shape of the injection hole inlet 12*a* is made sector-shaped to the extent that the injection hole inlet 12*a* does not fall outside a virtual oval shape 12*c*, of the injection hole outlet, that is formed when the shape of the injection hole outlet 12*b* is projected onto the upstream side face 11*c* of the injection hole plate 11 along the slant direction of the injection hole 12. The portion, of the injection hole inlet 12*a* that is formed in a sector shape, that is closer to the center axis 10*b* of the valve seat is formed as a large arc 12*g*; the portion, of the injection hole inlet 12*a*, that is farther from the center axis 10*b* of the valve seat is formed as a small arc. It may not be required to provide an arc at the portion that is farther from the center axis 10*b* of the valve seat.

As illustrated in FIG. 3(*d*), letting θ denote the angle between the lines obtained by vertically projecting the line that passes through the center of the injection hole inlet 12*a* and the center axis 10*b* of the valve seat and the line that connects the middle point of the virtual oval shape 12*c* with the sector-shaped main part of the injection hole inlet 12*a* onto the plane that passes the center of the sector-shaped arc portion 12*g* of the injection hole inlet 12*a* and is perpendicular to the center axis 10*b* of the valve seat, the relationship $\theta \leq 45°$ is satisfied. As a result, the ratio of the portion, to the arc portion 12*g* of the sector which is the shape of the injection hole inlet 12*a*, that is disposed closer to the center axis 10*b* of the valve seat is made large.

In Embodiment 2, because the ratio of the fuel flow 16*a*, to fuel flows that enter the injection hole inlet 12*a*, that enters the center of the injection hole inlet 12*a* becomes large, there is enhanced the flow 16*c* that intends to widen the liquid film 17 along the inner wall of the injection hole 12 whose cross sectional area becomes larger in the downstream direction of the fuel flow; thus, there is demonstrated an effect that the fuel film can efficiently be thinned.

The ratio of the fuel flow 16*b*, to fuel flows that enter the injection hole inlet 12*a*, that enters the position apart from the center of the injection hole inlet 12*a* becomes small and hence the flow that opposes the flow that intends to widen the liquid film 17 is suppressed; therefore, turbulence caused by collision of flows in the injection hole is also suppressed, whereby there is demonstrated an effect that the atomization of fuel is facilitated.

Moreover, because the injection hole outlet 12*b* is made wider than the injection hole inlet 12*a*, the injection hole is not filled with fuel even under a high-temperature and negative-pressure condition and hence the effect of pressure loss caused by gas-liquid two-phase flow is small; thus, the fuel injection valve according to Embodiment 2 of the present invention is characterized in that fluctuation in the injection amount due to the atmosphere is small.

Embodiment 3

Figure 4:
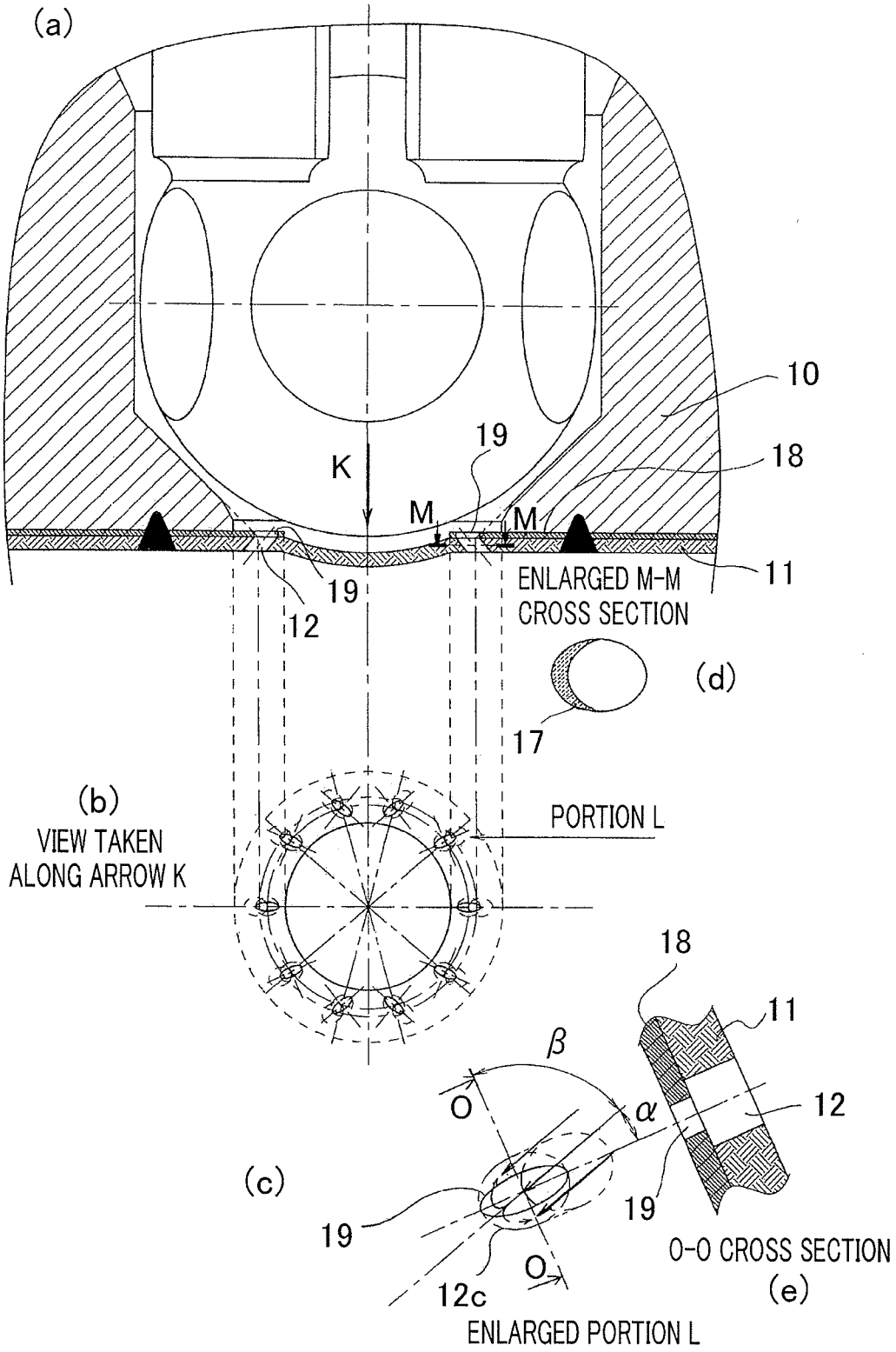
FIGS. 4*a*-4*e* are a set of explanatory views illustrating the detail of the front end portion of a fuel injection valve according to Embodiment 3 of the present invention.

FIG. 4 is a set of explanatory views illustrating the front end portion of a fuel injection valve according to Embodiment 3 of the present invention; FIG. 4(*a*) is a cross-sectional view; FIG. 4(*b*) is a plan view taken along the arrow K in FIG. 4(*a*); FIG. 4(*c*) is an enlarged view of the portion L; FIG. 4(*d*) is an enlarged cross-sectional view taken along the M-M line; and FIG. 4(*e*) is an enlarged view taken along the O-O line. As illustrated in FIG. 4, an intermediate plate 18 is provided between the valve seat 10 and the injection hole plate 11. In the intermediate plate 18, there is provided a nozzle hole 19 that communicates with the injection hole 12 of the injection hole plate 11; the shape of the cross section of the nozzle hole is made the same as that of the foregoing injection hole inlet 12*a* according to Embodiment 1.

Embodiment 3 makes it possible to obtain the same atomizing effect as that of Embodiment 1 through easy machining.

Embodiment 4

Figure 5:
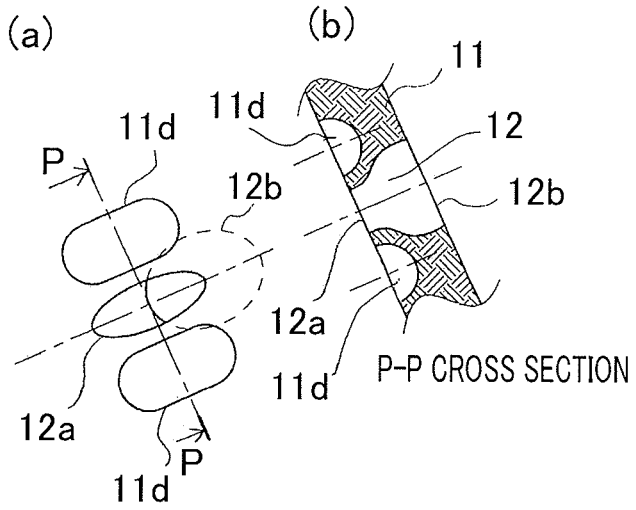
FIGS. 5*a* and 5*b* are a set of explanatory views illustrating the detail of the front end portion of a fuel injection valve according to Embodiment 4 of the present invention.

FIG. 5 is a set of explanatory views illustrating the front end portion of a fuel injection valve according to Embodiment 4 of the present invention; FIG. 5(*a*) is a plan view as viewed from the side of the injection hole inlet 12*a* of the injection hole plate 11; FIG. 5(*b*) is a cross-sectional view taken along the line P-P. In Embodiment 4, after the cylindrical injection hole 12 is formed through press molding in the injection hole plate 11, concavees 11*d* are formed by forging part of the periphery of the injection hole inlet 12*a*, so that the injection hole inlet 12*a* of the injection hole 12 is deformed to be oval-shaped.

Embodiment 4 makes it possible to readily obtain an injection hole plate 11 provided with the injection hole 12 described in Embodiment 1 and to obtain fuel injection valve in which the atomizing effect is improved.

Embodiment 5

Figure 6:
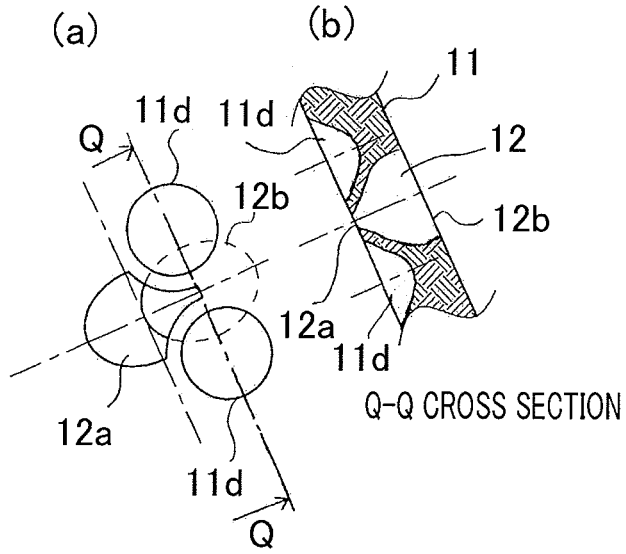
FIGS. 6*a* and 6*b* are a set of explanatory views illustrating the detail of the front end portion of a fuel injection valve according to Embodiment 5 of the present invention.

FIG. 6 is a set of explanatory views illustrating the front end portion of a fuel injection valve according to Embodiment 5 of the present invention; FIG. 6(*a*) is a plan view as viewed from the side of the injection hole inlet 12*a* of the injection hole plate 11; FIG. 6(*b*) is a cross-sectional view taken along the line Q-Q. In Embodiment 5, after the cylindrical injection hole 12 is formed through press molding in the injection hole plate 11, concavees 11*d* are formed by forging part of the periphery of the injection hole inlet 12*a*, so that the injection hole inlet 12*a* of the injection hole 12 is deformed to be sector-shaped.

Embodiment 5 makes it possible to readily obtain an injection hole plate 11 provided with the injection hole 12 described in Embodiment 2.

Embodiment 6

Figure 7:
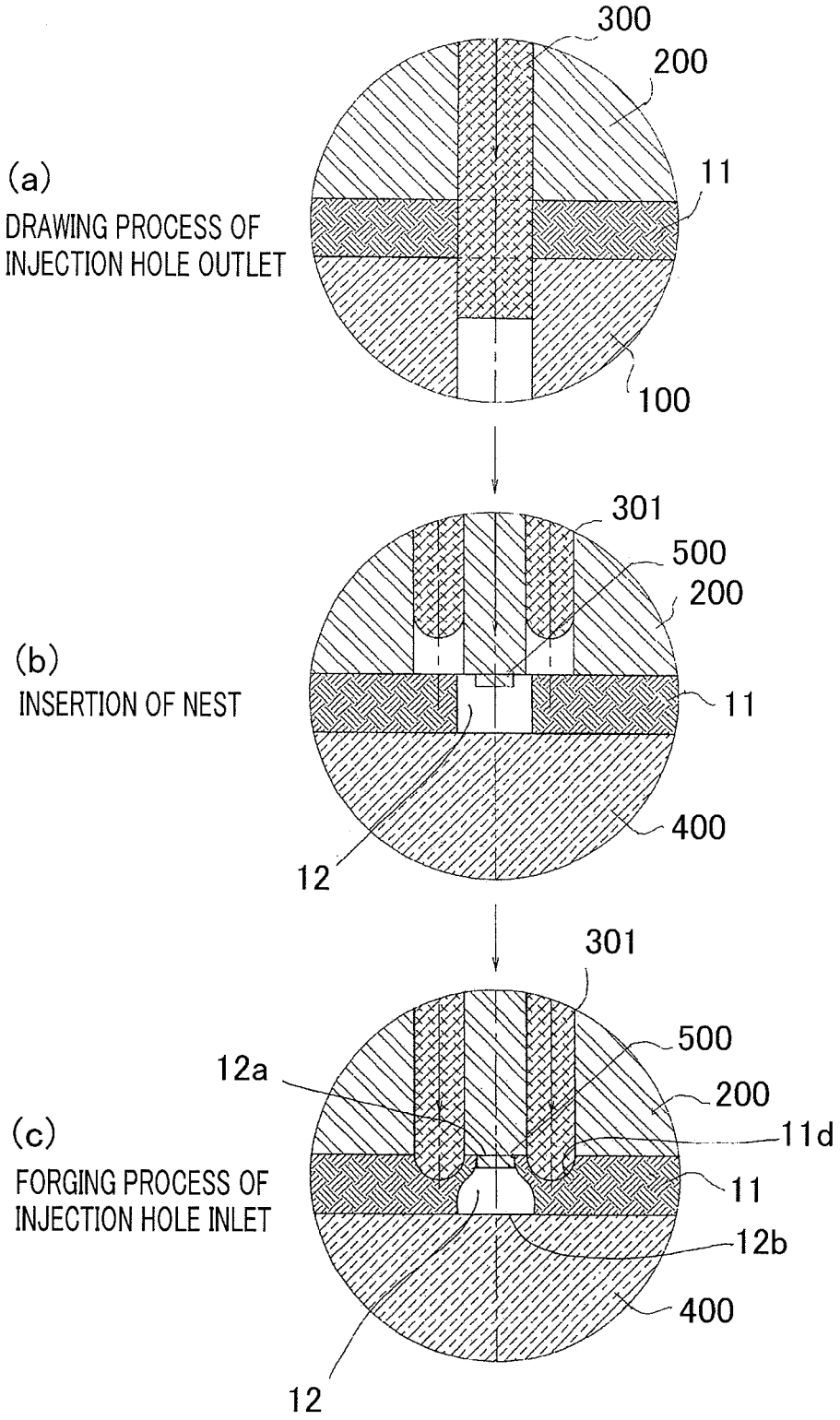
FIGS. 7*a*-7*c* are a set of explanatory views illustrating the detail of the front end portion of a fuel injection valve according to Embodiment 6 of the present invention.
Figure 8:
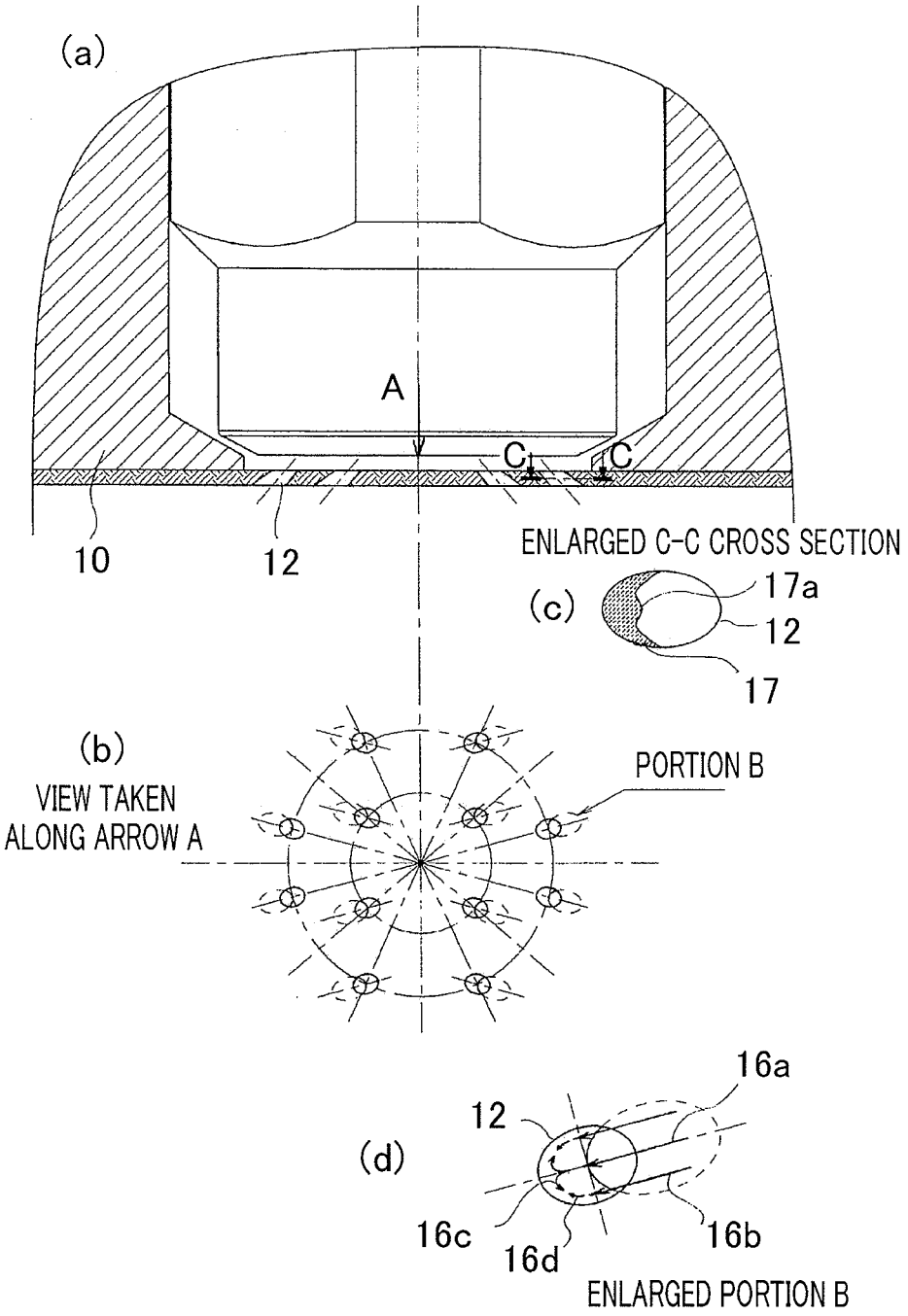
FIGS. 8*a*-8*d* are a set of explanatory views illustrating the detail of the front end portion of a conventional fuel injection valve.

FIG. 7 is a set of explanatory views illustrating the detail of the front end portion of a fuel injection valve according to Embodiment 6 of the present invention; FIG. 7(*a*) is an explanatory view for a step where a cylindrical injection hole is formed through a drawing process in an injection hole plate; FIG. 7(*b*) is an explanatory view for a step where a nesting device is inserted into the cylindrical injection hole; FIG. 7(*c*) is an explanatory view for a step where while the nesting device is inserted, forging machining is applied to the injection hole inlet of the injection hole plate.

In FIG. 7, at first, as illustrated in FIG. 7(*a*), by the intermediary of a punch guide 200, a punch 300 punches out a cylindrical injection hole in the injection hole plate 11 placed on a dice guide 100. Next, as illustrated in FIG. 7(*b*), the injection hole plate 11 is placed on a dice 400, a nesting device 500 is inserted into the injection hole 12 of the injection hole plate 11, and the punch guide 200 is placed; after that, as illustrated in FIG. 7(*c*), a punch 301 forges the vicinity of the injection hole inlet 12*a*, so that a concave 11*d* is formed. As a result, there can be obtained the injection hole plate 11 provided with the sector-shaped injection hole inlet 12*a* described in Embodiment 2.

Embodiment 6 makes it possible to readily obtain an injection hole plate 11 provided with the injection hole 12 described in Embodiment 2.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve comprising a valve body that makes contact with or departs from a seat surface of a valve seat, and when the valve body departs from the seat surface of the valve seat, fuel passes between the valve body and the seat surface of the valve seat and then is injected outward from a plurality of injection holes provided in an injection hole plate fixed to the valve seat, wherein the seat surface of the valve seat is formed in such a way that the inner diameter thereof decreases in a direction from an upstream side to a downstream side of a flow of the fuel;

the injection hole plate is disposed opposing a front end portion of the valve body in such a way that a virtual extension seat surface extended along the seat surface from a downstream edge of the seat surface and an upstream side face of the injection hole plate intersect each other to form a virtual circle;

each of the plurality of injection holes provided in the injection hole plate has an injection hole inlet that opens in an oval shape at the upstream side face of the injection hole plate and an injection hole outlet that opens in an oval shape at a downstream side face of the injection hole plate, and an injection hole path between the injection hole inlet and the injection hole outlet is formed in such a way as to be slanted by a predetermined angle with respect to a depth direction of the injection hole plate;

the injection hole inlet is disposed to be closer to the center axis of the valve seat than either the periphery of a valve seat opening portion having the minimum inner diameter of the valve seat or the injection hole outlet;

the oblateness of the oval shape of the injection hole inlet, which is expressed by a value obtained by dividing the length of the major axis of the oval shape of the injection hole inlet by the length of the minor axis thereof, is made larger than the oblateness of the oval shape of the injection hole outlet, to the extent that the periphery of the injection hole inlet does not fall outside a virtual oval shape that is formed when the shape of the injection hole outlet is projected onto the upstream side face of the injection hole plate along the direction of the slant of the injection hole path;

the injection hole inlet is disposed at the upstream side face of the injection hole plate in such a way that, when $\alpha$ denotes the angle between respective lines obtained by vertically projecting a straight line that passes through the center of the injection hole inlet and the center of the valve seat and the major axis of the injection hole inlet onto a perpendicular plane that passes through the center of the injection hole inlet and is perpendicular to the center axis of the valve seat and when $\beta$ denotes the angle between respective lines obtained by vertically projecting the straight line that passes through the center of the injection hole inlet and the center of the valve seat and the minor axis of the injection hole inlet onto the perpendicular plane, $\alpha<\beta$ is satisfied; and wherein the length of the major axis of the oval shape of the injection hole inlet is the same as the length of the major axis of the oval shape of the injection hole outlet, or the length of the minor axis of the oval shape of the injection hole inlet is smaller than the length of the minor axis of the injection hole outlet.

2. The fuel injection valve according to claim 1, wherein there is provided an intermediate plate inserted between the valve seat and the injection hole plate;

the intermediate plate is provided with a nozzle hole that communicates with an injection hole formed in the injection hole plate; and the shape of the nozzle hole is the same as that of the injection hole inlet.

3. The fuel injection valve according to claim 1, wherein after a cylindrical injection hole is formed through press molding in the injection hole plate, the injection hole inlet is formed by forging part of the periphery of the opening portion of the cylindrically formed injection hole.

4. The fuel injection valve according to claim 3, wherein the forging is performed with a nesting device inserted into the cylindrically formed injection hole.

* * * * *